US005145767A

United States Patent [19]

Whitcomb et al.

[11] Patent Number: 5,145,767

[45] Date of Patent: Sep. 8, 1992

[54] THERMALLY SENSITIVE COMPOSITIONS COMPRISED OF SALTS OF OXIDIZING ACIDS AND LEUCO DYES

[75] Inventors: David R. Whitcomb; Frank T. Sher, both of St. Paul, Minn.

[73] Assignee: Minnesota Mining and Manufacturing Company, St. Paul, Minn.

[21] Appl. No.: 552,886

[22] Filed: Jul. 16, 1990

[51] Int. Cl.[5] ..... G03C 1/72

[52] U.S. Cl. ..... 430/338; 430/336; 430/339; 430/341; 430/343; 430/344

[58] Field of Search ..... 430/338, 339, 341, 343, 430/344, 336

[56] References Cited

U.S. PATENT DOCUMENTS

| | | | |
|---|---|---|---|
| 4,336,232 | 6/1982 | Winslow | 430/339 |
| 4,336,323 | 6/1982 | Winslow et al. | 430/339 |
| 4,370,401 | 1/1983 | Winslow et al. | 430/339 |
| 4,373,020 | 2/1983 | Winslow | 430/339 |
| 4,379,835 | 4/1983 | Lowrey et al. | 430/343 |
| 4,386,154 | 5/1983 | Smith et al. | 430/336 |
| 4,394,433 | 7/1983 | Gatzke | 430/151 |
| 4,460,677 | 7/1984 | Smith et al. | 430/336 |
| 4,647,525 | 3/1987 | Miller | 430/338 |
| 4,889,932 | 12/1989 | Miller | 430/338 |

*Primary Examiner*—Charles L. Bowers, Jr.
*Assistant Examiner*—Thorl Chea
*Attorney, Agent, or Firm*—Gary L. Griswold; Walter N. Kirn; Mark A. Litman

[57] ABSTRACT

Novel thermally sensitive imageable layers comprising a leuco dye oxidizing acid salt are disclosed, wherein said acid consists of a Group V, VI, or VII element and oxygen.

25 Claims, No Drawings

THERMALLY SENSITIVE COMPOSITIONS COMPRISED OF SALTS OF OXIDIZING ACIDS AND LEUCO DYES

CROSS-REFERENCE TO RELATED CASES

This case is related to "Light Sensitive Elements", U.S. Ser. No. 83,522 filed Aug. 7, 1987, continued as U.S. Ser. No. 394,250, filed Aug. 11, 1989.

BACKGROUND OF THE INVENTION

1. Field of the Invention

This invention relates to thermographic imaging systems, particularly those involving thermally assisted oxidation of a leuco dye to generate color.

2. Background of the Related Art

With the advent of digital image processing, thermographic imaging systems have become increasingly more important for printout systems. It is desirable that thermographic systems be essentially solvent free for environmental and other practical reasons. The present invention satisfies these needs by complexing leuco dyes with oxidizing anions in a binder to form relatively stable thermographic compositions. The compositions of the present invention overcome the need for diffusion in the oxidation step, thereby allowing rigid binders to be used.

Many processes and compositions use leuco dyes to provide optical densities in the imaged article. More specifically leuco dyes which are converted to colored forms by chemical oxidation (i.e., oxidatively triggerable leuco dyes), have been widely used in thermographic applications. Examples of leuco dyes used in color image forming systems include triarylmethanes, xanthenes, styryl dyes, and azine dyes, such as, phenoxazines, phenothiazines, and phenazines.

Acid salts of leuco dyes have been employed in electrochromic imaging systems (e.g., U.S. Pat. Nos. 3,390,994, and 4,444,626).

Acid salts of leuco dyes have also been employed in photosensitive imaging systems (U.S. Pat. Nos. 3,630,736 and 3,445,234). Leuco dye acid salts were employed in cases where the oxidized dye form was cationic. Despite claims to the utility of salts with oxidizing acids, no examples other than chlorides and p-toluenesulfonates were given. The imaging system of those patents is not thermally developed and requires the use of a hexaarylbiimidazole photosensitizer.

U.S. Pat. Nos. 4,373,020 and 4,336,323 describe thermally sensitive imaging systems comprised of a binder, nitrate, organic acid, and a leuco dye or bleachable dye, respectively.

U.S. Pat. No. 4,379,835 achieves a thermally sensitive imaging system with a black image by combining two leuco dyes with a metal nitrate, binder and organic acid. U.S. Pat. No. 4,563,415 discloses a thermally sensitive imaging composition comprised of a naphthoylated leuco dye, nitrate salt, and, optionally, a stabilizing compound and organic acid. Although the organic acid is optional, its presence greatly reduces the development temperatures required.

U.S. Pat. No. 4,423,139 discloses stabilizers for leuco dye nitrate salt thermographic systems. Imaging systems comprising an oxidation tripped leuco dye, nitrate salt, and organic acid show marked instability in the presence of even small quantities of moisture, particularly while in solution during formulation prior to coating. The compositions of the present invention overcome this instability by using a preformed oxidizing acid salt of a leuco dye thereby removing the need for added organic acid. The coating solutions of the present invention show marked improvements in stability, and importantly, reproducibility.

Japanese Pat. No. 88,058,108 teaches the use of salts of heptavalent and hexavalent molybdenum compounds and benzoyl leuco methylene blue in thermally imaged compositions. Also included are nitric acid salts of leuco methylene blue, but only when simultaneously in the form of a molybdenum complex or salt. Nitric acid, sulfuric acid, and hydrochloric acid are taught as forming useful salts with leuco methylene blue in the presence of molybdenum compounds.

Japanese Pat. No. 88,058,109 teaches the use of salts of heptavalent molybdenum compounds and benzoyl leuco methylene blue in thermally imaged compositions. Also required is an included compound containing both oxidizer and reducer moieties.

Japanese Pat. No. 88,058,110 describes the use of salts of hexavalent and heptavalent molybdenum compounds condensed to form iso- and hetero-polyacids in thermally imaged compositions.

Japanese Pat. No. 88,058,111 discloses the use of salts of hexavalent and heptavalent molybdenum compounds in the presence of blocked phenols in thermally imaged compositions. In the latter four disclosures, only blue to black images were successfully generated. This is expected, since molybdic acid oxidation of organic compounds generally leads to dark blue-black color formation. This fact makes molybdenum based oxidizers unsuitable for applications in which other colors such as red or green are desired. Systems without molybdenum compounds therein are therefore desirable.

The compositions of the present invention offer an improvement over leuco dye, nitrate salt systems of the prior art in that the preassociation of the leuco dye and oxidizing acid leads to improved thermographic sensitivity and environmental stability.

SUMMARY OF THE INVENTION

The present invention provides a thermally sensitive composition which has reduced moisture sensitivity (especially to environmental or atmospheric humidity) and increased thermal sensitivity.

The present invention also provides a method for the preparation of oxidizing acid salts of leuco dyes which does not result in premature oxidation of the leuco dye.

The present invention further provides a thermally sensitive composition which is dispersed in a binder layer, and a thermally sensitive composition which is dispersed in a binder, and coated on a substrate to provide a thermally imageable layer.

The present invention can also provide a thermally sensitive composition is coated onto a substrate without the aid of a binder.

The present invention is achieved by providing leuco dye oxidizing acid salts, which are prepared as described herein.

DETAILED DESCRIPTION AND SPECIFICATION OF THE INVENTION

Leuco Dye Oxidizing Acid Salts

Leuco dye oxidizing acids salts as defined herein consist of a salt or mixed salt of an oxidatively triggerable leuco dye and one or more oxidizing acids.

Oxidatively triggerable leuco dyes are well known. These are colorless compounds which when subjected to an oxidation reaction form colored dyes. These leuco dyes are well described in the art (e.g., U.S. Pat. No. 3,974,147, *The Theory of Photographic Process*, 4th Ed.; Mees, C. E. K.; James, R.; MacMillan: New York, 1966; pp 283–284, 390–391; and Kosar, J. *Light-Sensitive Systems*; John Wiley and Sons: New York, 1965; pp 367, 370–380, 406. Only those leuco dyes which can be converted to colored dyes by oxidation are useful in the practice of the present invention. Preferred leuco dyes include acylated leuco azine, phenoxazine, and phenothiazine dyes, examples of which are disclosed in U.S. Pat. Nos. 4,460,677, 4,647,525 and G.B. Pat. No. 1,271,289.

Oxidizing acids are well known in the art and include, but are not limited to nitric, nitrous, peroxonitric, hyponitrous, perchloric, periodic, peroxophosphoric, chromic, permanganic, oxalic, peroxosulfuric, and sulfurous acids as well as organic peracids. For the purposes of this invention the term "stable oxidizing acid" is defined as an oxidizing acid which: 1) must be derived from a Group V, VI or VII element, (Barrow, C. *General Chemistry*; Wadsworth: Belmont, Calif., 1972, p 162), and 2) form a stable salt with the leuco dye at ambient temperature, and 3) the oxidizing acid must not react with dialkyl or cyclic ethers at 25° C. when said oxidizing acid is present at concentrations of less than 0.02M. Preferably, the oxidizing acid is nitric or perchloric acid which generally satisfy the aforementioned conditions. More preferably the oxidizing acid is nitric acid.

Acid or base sensitive dyes such as phenolphthalein and other indicator dyes are not useful in the present invention. Further, only those leuco dyes which have basic functionality capable of forming an acid base salt with an oxidizing acid are useful in the practice of the present invention. Accordingly, the leuco dye must contain at least one of a 1°, 2°, or 3° amine, and the anion must be derived from an oxidizing acid having a $pK_a$ less than or equal to about 0.

The imageable compositions of the present invention must be substantially anhydrous, that is they perform optimally in the absence of moisture. It is however acceptable to have moisture in small quantities, preferably less than about 2 percent by weight.

The leuco dye oxidizing acid salt should be present as at least about 0.1 percent and less than about 25 percent by weight of the total weight of the thermally sensitive composition. Preferably the oxidizing acid leuco dye salt should be present as 0.1 to 5.0 percent by weight of the dry weight of the imageable composition, and most preferably as 0.1 to 3.0 percent by weight of the dry weight of the imageable composition.

It should be further noted that the compositions of the present invention are sensitive to temperatures as low as about 70° C. while compositions known in the art tend to be sensitive in the range of 120° C. or higher.

Binder

The term binder as used herein refers to a continuous film-forming material in which the leuco dye oxidizing acid salts of this invention may be dissolved or dispersed. Any natural or synthetic polymeric binder may be used in the practice of this invention. Organic polymeric resins, preferably thermoplastic resins (although thermoset resins may be used) are generally preferred.

Such resins as phenoxy resins, polyesters, polyvinyl resins, polycarbonates, polyamides, polyvinyl acetals, polyvinylidene chloride, polyacrylates, cellulose esters, copolymers and blends of these classes of resins, and others are preferred. Where the proportions and activities of leuco dye oxidizing acid salts require a particular developing time and temperature, the resin should be able to withstand those conditions. Generally, it is preferred that the polymer not decompose or lose its structural integrity at 200° F. (93° C.) for 30 seconds and most preferred that it not decompose or lose its structural integrity at 260° F. (127° C.). More preferably, polymers include polyvinylidene chloride resins (e.g., Saran TM supplied by Dow Chemical, Midland, Mich.), phenoxy resins (e.g., PKHH TM and PAHJ TM supplied by Union Carbide, Hackensack, N.J.), and polyvinyl acetals (e.g., Formvar TM and Butvar TM supplied by Monsanto Chemical, St. Louis, Mo.).

Beyond these minimal requirements, there is no criticality in the selection of a binder. In fact, even transparency and translucency are not required although they are often desirable.

The binder may serve a number of additionally important purposes in the constructions of the present invention. The consistency of the coating and its image quality are improved. The durability of the final image is also significantly improved.

In those cases in which a binder is employed, the binder should be present as at least about 25% by weight of dry ingredients in the layer, more preferably as 50% or 70% by total weight of the dried layer and most preferably as at least about 80% by total weight of dry ingredients (i.e., excluding solvents in the layer). A generally useful range is 30–98 percent by weight binder with 75 to 95 percent preferred.

Substrate

Suitable substrates on which the compositions of the present invention may be supported include, but are not limited to, metals (e.g., steel and aluminum plates, sheets, and foils); films or plates composed of various film-forming synthetic or high polymers including addition polymers (e.g., polyvinylidene chloride, polyvinyl chloride, polyvinyl acetate, polystyrene, polyisobutylene polymers and copolymers), and linear condensation polymers (e.g., polyethylene terephthalate, polyhexamethylene adipate, polyhexamethylene adipamide/adipate); nonwoven wood by-product based substrates such as paper and cardboard; and glass.

Substrates may be transparent, translucent, or opaque.

The imageable layers of the present invention may contain various materials in combination with the essential ingredients of the present invention. For example, plasticizers, coating aids, antioxidants (e.g., ascorbic acid, hindered phenols, phenidone, etc. in amounts that would prevent oxidation of dyes when heated), surfactants, antistatic agents, waxes, ultraviolet radiation absorbers, mild oxidizing agents in addition to the leuco dye oxidizing acid salt, and brighteners may be used without adversely affecting the practice of the invention.

EXAMPLES

All materials employed in the following examples are available from Aldrich Chemical Company (Milwaukee, Wis.), unless otherwise specified.

Materials prepared in the examples below were examined or analyzed by at least one of the following techniques: $^1H$ nuclear magnetic resonance, infrared, ultraviolet, and mass spectroscopy; differential scanning calorimetry (DSC); and elemental analysis. All materials gave results consistent with the corresponding structures given herein. Pergascript Turquoise TM was obtained from Ciba-Geigy (Ardsley, N.Y.), Copikem II TM was obtained from Hilton-Davis (Cincinnati, Ohio). Tetrahydrofuran is abbreviated THF.

Magenta LD was prepared according to EP Pat. No. 181,085. Yellow LD2 was prepared according to the procedure of Bose, A. K.; Garrat, S. *J. Am. Chem. Soc.* 1962, 84, 1310. Yellow LD1 and Green LD were prepared according to U.S. Pat. No. 3,297,710. Purple LD was prepared according to U.S. Pat. No. 4,647,525. Cyan Dimer was prepared according to Japanese Pat. No. 75,020,809.

The term $D_{max}$ refers to maximum transmission optical density in the light exposed regions after thermal development.

The term $D_{min}$ refers to minimum transmission optical density in the nonlight exposed region after thermal development. Densitometry measurements were made using a MacBeth Instrument Co. densitometer (Newburgh, N.Y.).

The term wt % refers to weight/weight percent.

A process for preparation of the thermally sensitive composition according to the present invention having the formula:

$H^+$(Leuco Dye)$_n$(Oxidizing Acid Conjugate Base)$_p^-$ comprises the steps of preparing a Solution I by dissolving n equivalents of an oxidatively triggerable leuco dye in substantially anhydrous diethyl ether, preparing a solution II by dissolving p equivalents of oxidizing acid in substantially anhydrous diethyl ether, combining solutions I and II, and filtering the resultant salt precipitate.

EXAMPLES 1-13

The following examples teach the preparation of leuco dye oxidizing acid salts with the stoichiometry ((leuco dye) x n HX, wherein n is any positive real number), useful in the practice of this invention. One mmol, about 0.4 g, of leuco dye was dissolved in 60 ml anhydrous diethyl ether, and the resultant solution was optionally cooled to 0° C. A separate solution consisting of n mmol of the concentrated oxidizing acid to be used dissolved in 10 ml anhydrous diethyl ether was added to the cold leuco dye solution whereupon a salt immediately precipitated. The product was collected by suction filtration, washed with ether, and dried in vacuo. Generally, yields of 80–90% were obtained. For those dyes which were insoluble in diethyl ether an alternate procedure was used in which nitric acid in diethyl ether is added to the leuco dye in a minimum amount of tetrahydrofuran (60 ml diethyl ether); concentrated nitric acid may start a fire if added directly to tetrahydrofuran.

TABLE 1

| Example | Acid | Leuco Dye | Decomp. Temp. (°C.) | Ratio (acid/dye) |
|---|---|---|---|---|
| 1 | $HNO_3$ | Copikem II TM | 99 | 2:1 |
| 2 | " | Pergascript TM Turquoise | 93 | 1:1 |
| 3 | " | Pergascript TM Turquoise | 91 and 180 | 2:1 |
| 4 | " | Magenta LD | 97 | 1:1 |
| 5 | " | Yellow LD1 | 140 | 1:1 |
| 6 | " | Yellow LD2 | 89 | 1:1 |
| 7 | " | Green LD | 187 | 1:1 |
| 8 | " | Purple LD | 96 | 1:1 |

TABLE 1-continued

| Example | Acid | Leuco Dye | Decomp. Temp. (°C.) | Ratio (acid/dye) |
|---|---|---|---|---|
| 9 | " | Cyan Dimer | 122 | 1:1 |
| 10 | " | Malachite Green | 92 | 1:1 |
| 11 | $HClO_4$ | Pergascript TM Turquoise | 164 | 1:1 |
| 12 | " | Magenta LD | 152 | 1:1 |
| 13 | $H_5IO_6$ | Pergascript TM Turquoise | 75 | 1:1 |

EXAMPLES 14-29

The following examples demonstrate the utility of the imageable layers of the present invention. In the following examples the leuco dye oxidizing acid salt was dissolved in 20% PKHH (Union Carbide, Hackensack, N.J.) in tetrahydrofuran (freshly distilled from benzophenone ketyl), knife coated at 4 mil wet thickness, air dried at room temperature for 15 minutes, then oven dried at 50° C. for 5 minutes. The results are shown in Table 2. The thermal activation temperature was determined by placing a strip of the dried coating on a Reichert Heizbank (Cambridge Instruments, Buffalo, N.Y.), thermal gradient bar. The thermal activation temperature was determined by observing the onset of color formation from the oxidized leuco dye after 20 seconds of contact with the thermal gradient bar.

TABLE 2

| Example | Leuco Dye Acid Salt | Dye Salt wt % | Δ Activation Temp. (°C.) | $D_{max}$ | $D_{min}$ |
|---|---|---|---|---|---|
| 14 | PT[a] × $2HNO_3$ | 0.51 | 71 | 1.74 | 0.21 |
| 15 | PT × $2HNO_3$ | 0.26 | 76 | 0.83 | 0.06 |
| 16 | PT × $2HNO_3$ | 1.02 | 64 | 3.65 | 0.66 |
| 17 | PT × $HNO_3$ | 0.49 | 97 | 1.95 | 0.10 |
| 18 | PT × $HNO_3$ | 0.09[b] | 87 | 2.31 | 0.11 |
| 19 | Yellow LD1 × $HNO_3$ | 0.23 | 104 | 0.44 | 0.01 |
| 20 | Magenta LD × ½ $HNO_3$ | 0.81 | 74 | 1.00 | 0.20 |
| 21 | Yellow LD2 × $HNO_3$ | 0.51 | 98 | 0.59 | 0.05 |
| 22 | Yellow LD2 × $HNO_3$ | 1.6[c] | 122 | 0.25 | 0.01 |
| 23 | Yellow LD2 × $HNO_3$ | 0.8[b] | 130 | 0.15 | 0.01 |
| 24 | PT × HCL × $HNO_3$ | 0.51 | 112 | 2.65 | 0.15 |
| 25 | PT × $H_2SO_4$ × $HNO_3$ | 0.51 | 75 | 1.83 | 0.09 |
| 26 | Copikem II TM × $HNO_3$ | 0.56 | 78 | 2.73 | 0.15 |
| 27 | Magenta LD × $HClO_4$ | 1.2 | 152 | 1.89 | 0.07 |
| 28 | Malachite Green × $HNO_3$ | 3.3 | 92 | 1.61 | 0.09 |
| 29 | Yellow LD2 × | 3.3 | 97 | 0.88 | 0.04 |

TABLE 2-continued

| Example | Leuco Dye Acid Salt | Dye Salt wt % | Δ Activation Temp. (°C.) | $D_{max}$ | $D_{min}$ |
|---|---|---|---|---|---|
| | $HNO_3$ | | | | |

[a]Pergascript ™ Turquoise S-2G.
[b]10% Saran ™ F310 in 2-butanone employed as binder solution in place of PKHH/THF solution.
[c]5% GEON ™ Polyvinyl chloride in tetrahydrofuran (B. F. Goodrich, Chicago, IL).

EXAMPLES 30–37

The following examples illustrate that nonoxidizing anions are not useful in the present invention. The examples in Table 3 were analyzed by DSC as in Examples 14–29 up to a minimum high temperature of 200° C. No other thermal behavior was seen beyond that noted. Only endotherms were seen with nonoxidizing anions while exotherms are generally seen with oxidizing anions. Examples 1–13 all decompose with exothermic behavior.

TABLE 3

| Example | Leuco Dye Acid Salt | Thermal Activation Temperature (°C.) | Notes |
|---|---|---|---|
| 30 | PT[a] × 2 HCl | 90 | endotherm |
| 31 | PT × 2 $H_2SO_4$ | 90 | endotherm |
| 32 | PT × $H_3PO_4$ | 70 | endotherm |
| 33 | PT × $PhSO_3H$ | 60 | endotherm |
| 34 | PT × $HBF_4$ | >200 | |
| 35 | Copikem ™ II × 2 HCl × 2 $H_2O$ | >200 | |
| 36 | Magenta LD × HCl × $H_2O$ | 75 | endotherm |
| 37 | Magenta LD × $PhSO_3H$ | 70 | endotherm |

[a]PT refers to Pergascript ™ Turquoise.

EXAMPLE 38

This example demonstrates that the imageable layers of the present invention may be dispersed on paper instead of a synthetic polymeric binder. Pergascript Turquoise×$HNO_3$ powder (Example 1), was poured onto non-glossy plotter paper Hewlett-Packard, cat. no. 17801P, Falcon, Heights, Minn.). The powder was spread uniformly over the surface using a squeegee. The onset temperature for thermal development was determined according to the procedure of Example 14, and measured at 105° C.

EXAMPLE 39

This example demonstrates that the present invention achieves reduced moisture sensitivity and increased thermal sensitivity compared to the prior art. Solution A was prepared by preparing a 20% PKHH in THF. Solution B was prepared by dissolving 17.3 mg (0.04 mmol) Pergascript TM Turquoise in 6 g. Solution A and adding 0.2 g methanol. Solution C was prepared by dissolving 17.3 mg (0.040 mmol) Pergascript TM Turquoise in 6 g Solution A and adding 0.2 g methanol, 0.04 mmol $LiNO_3$, and 0.04 mmol HCl in 200 mg of solution A. Solution D was prepared by dissolving 20.1 mg (0.04 mmol) Pergascript TM Turquoise mono nitric acid salt in 6 g solution A and adding 0.2 g methanol. Solutions B, C, and D, were coated at 3 mil (0.076 mm) wet thickness onto polyethylene terephthalate film, dried 15 minutes at room temperature, and 5 minutes at 50° C. The coated films were exposed to moisture as indicated in Table 4 and $D_{max}$ optical densities were measured following development at 160° C. for 20 seconds.

TABLE 4

| Solution | $D_{max}$ 0 min 45% RH[a] 20° C. | 120 min 100% RH 60° C. | 480 min 100% RH 60° C. |
|---|---|---|---|
| B | 0.03 | 0.02 | 0.00 |
| C | 0.11 | 0.06 | 0.02 |
| D | 0.51 | 0.48 | 0.44 |

[a]Relative humidity.

EXAMPLE 40

This example demonstrates the improved thermal sensitivies of thermally sensitive compositions of the present invention relative to those of the prior art. The following solutions were prepared:

Solution E: 15 wt % nitrocellulose, 0.33 wt % Pergascript TM Turquoise mono nitric acid salt, in THF.

Solution F: 15 wt % nitrocellulose, 0.30 wt % Pergascript TM Turquoise, 3.0 wt % of a methanol solution containing 3.0 mg magnesium nitrate and 0.9 mg succinic acid per gram of methanol, in THF.

Solution G: 15 wt % Butvar TM B-76, 0.33 wt % Pergascript Turquoise mono nitric acid salt, in THF.

Solution H: 15 wt % Butvar B-76 TM, 0.30 wt % Pergascript Turquoise, 3.0 wt % of a methanol solution containing 3.0 mg magnesium nitrate and 0.9 mg succinic acid per gram of methanol, in THF.

The solutions were independently coated at 4 mil (0.1 mm) wet thickness onto polyethylene terephthalate film, dried 15 minutes at room temperature, then dried 5 minutes at 50° C. The results are summarized in Table 5.

TABLE 5

| Solution | Development Temperature (°C.) | $D_{max}$ |
|---|---|---|
| E | 98 | 0.56 |
| F | >180 | 0.03 |
| G | 102 | 0.52 |
| H | 140 | 0.58 |

The invention has been described in detail with particular reference to preferred embodiments thereof, but it will be understood that variations and modifications can be effected within the spirit and scope of the invention.

What is claimed is:

1. A thermally sensitive composition capable of undergoing a visible change upon the application of heat without decomposition of the composition comprising the product of an oxidatively triggerable leuco dye and a stable oxidizing acid, wherein said acid comprises a Group V, VI, or VII element, hydrogen and oxygen.

2. An imageable layer comprising a thermally sensitive composition according to claim 1.

3. An imaged layer comprising a thermally sensitive composition according to claim 1 which has been heated in an imagewise manner to form a dye image.

4. An imageable layer according to claim 2 wherein said oxidizing acid is an inorganic oxidizing acid having a nitrogen, chlorine, or iodine atom.

5. An imageable layer according to claim 2 wherein said oxidizing acid is selected from the group consisting of nitric or perchloric acid.

6. An imageable layer according to claim 2 wherein a binder is also present.

7. An imageable layer according to claim 2 bonded to a substrate.

8. An imageable layer of claim 7 in which the substrate is paper.

9. An imageable element comprising the layer of claim 6 bonded to a substrate.

10. An imageable element of claim 9 in which the substrate is paper.

11. An imageable layer according to claim 2 wherein said leuco dye is a dialkylamino substituted leuco dye.

12. An imageable layer according to claim 2 wherein said leuco dye is a dialkylaminophenothiazine type leuco dye.

13. An imageable layer according to claim 2 wherein said leuco dye is a dialkylaminophenoxazine type leuco dye.

14. An imageable layer according to claim 2 wherein said leuco dye is a dialkylaminodiazine type leuco dye.

15. The layer of claim 1 wherein said product is a salt.

16. The layer of claim 2 wherein said product is a salt.

17. The layer of claim 4 wherein said product is a salt.

18. The layer of claim 6 wherein said product is a salt.

19. The layer of claim 9 wherein said product is a salt.

20. A thermally sensitive composition capable of undergoing a visible change upon the application of heat without decomposition, said composition consisting essentially of a) the product of an oxidatively triggerable leuco dye and a stable oxidizing acid, wherein said acid comprises a Group V, VI, or VII element, hydrogen and oxygen, and b) an organic polymeric binder, said product being a salt present as from 0.1 to less than 25% by dry weight of said composition.

21. An imageable layer comprising a thermally sensitive composition according to claim 20.

22. An imageable layer according to claim 21 wherein said oxidizing acid is an inorganic oxidizing acid having a nitrogen chlorine, or iodine atom.

23. An imageable layer according to claim 21 wherein said oxidizing acid is selected from the group consisting of nitric and perchloric acid.

24. An imageable layer according to claim 23 bonded to a substrate.

25. An imageable layer according to claim 23 wherein said leuco dye is a dialkylamino substituted leuco dye.

* * * * *